US005998073A

United States Patent [19]

Kuramoto et al.

[11] Patent Number: 5,998,073

[45] Date of Patent: Dec. 7, 1999

[54] DRY TONER FOR ELECTROPHOTOGRAPHY

[75] Inventors: Shinichi Kuramoto; Shohichi Sugimoto, both of Shizuoka, Japan

[73] Assignee: Ricoh Company, Ltd., Tokyo, Japan

[21] Appl. No.: 09/037,537

[22] Filed: Mar. 10, 1998

[30] Foreign Application Priority Data

Mar. 10, 1997 [JP] Japan ..... 9-072691

[51] Int. Cl.[6] ..... G03G 9/087

[52] U.S. Cl. ..... 430/106; 430/110

[58] Field of Search ..... 430/106, 109, 430/137, 110

[56] References Cited

U.S. PATENT DOCUMENTS

| | | | |
|---|---|---|---|
| 5,061,588 | 10/1991 | Fushimi et al. | 430/109 |
| 5,554,478 | 9/1996 | Kuramoto et al. | 430/109 |
| 5,840,456 | 11/1998 | Tomita et al. | 430/110 |

*Primary Examiner*—John Goodrow
*Attorney, Agent, or Firm*—Oblon, Spivak, McClelland, Maier & Neustadt, P.C.

[57] ABSTRACT

A dry toner for electrophotography includes a coloring agent, a releasing agent, and a polyol resin having a polyoxy alkylene moiety in a main chain thereof, with a ratio of Mw/Mn of 4 to 10, serving as a binder resin, which is synthesized by allowing an epoxy resin, a dihydric phenol, and an alkylene oxide adduct of a dihydric phenol, or a glycidyl ether thereof to react.

13 Claims, No Drawings

DRY TONER FOR ELECTROPHOTOGRAPHY

BACKGROUND OF THE INVENTION

1. Field of the Invention

The present invention relates to a dry toner for electrophotography, in particular to a dry toner for use in an electrophotographic full-color image formation apparatus which does not require a large size image fixing unit provided with a silicone oil tank or a circulation system.

2. Discussion of Background

In dry type electrophotography, a latent electrostatic image is formed on a photoconductor and is then developed with a dry toner to a toner image, and the toner image is then transferred to an image transfer paper and thermally fixed thereto, usually using a heat roller, whereby a toner image bearing copy is obtained.

In particular, in order to obtain a full-color image by the above-mentioned dry type electrophotography, it is required that the glossiness and coloring of the image be excellent, so that a binder resin as disclosed in Japanese Laid-Open Patent Application 7-77832 is employed in a color toner for obtaining a full-color image.

However, a conventional color image formation apparatus requires a large size image fixing unit provided with a silicone oil tank or a circulation system in order to obtain full-color images with excellent glossiness and coloring.

In contrast, a coloring system using a simple image fixing unit is conventionally proposed. However, the characteristics required for a toner which is suitable for use in such a coloring system have not yet been sufficiently studied, so that there is no choice but to use a conventional toner which is not always suitable for the color system and therefore images with sufficient glossiness and excellent coloring are not currently obtained.

SUMMARY OF THE INVENTION

It is therefore an object of the present invention to provide a color toner which has the following characteristics, when used together with a simple image fixing unit which performs oil application, using an oil application roller or an oil application felt: (1) providing clear and glossy color images, (2) providing color images with stable glossiness over a wide image fixing temperature range, (3) providing color images with uniform glossiness, (4) having excellent preservability, and (5) having excellent productivity.

This object of the present invention can be achieved by a dry toner for electrophotography comprising a coloring agent, a releasing agent, and a polyol resin comprising a polyoxy alkylene moiety in a main chain thereof, with a ratio of Mw/Mn of 4 to 10, in which Mw and Mn are respectively the weight average molecular weight and the number average molecular weight of the polyol resin, which polyol resin serves as a binder resin for the toner and is synthesized by allowing (a) an epoxy resin, (b) a dihydric phenol, and (c) an alkylene oxide adduct of a dihydric phenol, or a glycidyl ether thereof to react. The epoxy resin, the dihydric phenol and the alkylene oxide adduct of a dihydric phenol or a glycidyl ether thereof are respectively hereinafter referred to as the epoxy resin (a), the dihydric phenol (b) and the alkylene adduct component (c).

In the above dry toner, it is preferable that the polyol resin be synthesized by using the alkylene adduct component (c) in an amount of 10 to 40 parts by weight with respect to 100 parts by weight of the polyol resin synthesized.

Further, in the above dry toner, it is preferable that the epoxy resin comprise at least two bisphenol A type epoxy resins, each having a different number average molecular weight.

Further, in the above dry toner, it is preferable that the polyol resin have an epoxy equivalent of 20,000 or more.

Further, in the above dry toner, it is preferable that the polyol resin have a softening point of 115° C. to 130° C.

Further, in the above dry toner, it is preferable that the alkylene adduct component (c) be in an amount of 10 to 50 parts by weight with respect to 100 parts by weight of the epoxy resin in the polyol resin.

Furthermore, in the above dry toner, it is preferable that the releasing agent have a melting point of 70° C. to 100° C.

DESCRIPTION OF THE PREFERRED EMBODIMENTS

The color toner of the present invention comprises a coloring agent, a releasing agent, and a polyol resin comprising a polyoxy alkylene moiety in a main chain thereof, with a ratio of Mw/Mn of 4 to 10, which polyol resin serves as a binder resin for the toner and is synthesized by allowing the epoxy resin (a), the dihydric phenol (b) and the alkylene adduct component (c) to react.

The toner of the present invention is capable of providing clear and glossy color images.

Generally, the glossiness required for the color toner is said to be sufficient when a printed area has an average glossiness of 5 or more since when the glossiness is in such range, a clear color tone can be obtained. It is preferable that the glossiness be 10 or more.

Further, the toner of the present invention is capable of providing color images with stable glossiness over a wide image fixing temperature range. The wider the image fixing temperature range, the less the image is affected by ambient conditions thereunder, and the stabler the image with respect to the glossiness thereof in the course of a continuous printing operation. It is preferable that the image fixing temperature be at least 10° C., more preferably about 30° C.

Further, the toner of the present invention is capable of providing color images with uniform glossiness. The term "color images with uniform glossiness" means color images free of image areas with non-uniform glossiness, namely, color images without having a higher or lower glossiness than that of other image areas, for instance, free of such color images as having a higher glossiness in a leading image portion and a lower glossiness in a middle portion of the image area.

Further, the toner of the present invention has excellent preservability. The preservability of the toner means a degree of not becoming hard or solidified while preserved at high temperature. The preservability of the toner can be evaluated by penetration of a loaded needle into the toner which is preserved at high temperature.

Further, the toner of the present invention has excellent productivity. The term "excellent productivity" means that the toner can be produced without producing by-products which hinders the production of the toner, and also without any adverse effects on the health of the people who are involved in the production of the toner, and also means that the produced toner is safe to the user, since the toner may accidentally come into contact with the skin during manufacture, handling an use and the toner must not induce, for instance, skin hypersensitivity.

The polyol resin for use in the present invention is a polyether polyol resin which has an epoxy skeleton.

When the Mw/Mn ratio of the polyol resin is less than 4, the toner tends to cause an offset phenomenon when the simple oil application type image fixing unit is used, which uses an oil roller or an oil application roller, so that a sufficiently wide image fixing temperature range cannot be substantially obtained, while when the Mw/Mn ratio of the polyol resin is more than 10, sufficient glossiness and coloring cannot be attained and accordingly the object of the present invention cannot be achieved. Therefore, in the present invention, the Mw/Mn ratio of the polyol resin is in the range of 4 to 10, and it is preferable that the Mw/Mn ratio of the polyol resin be in the range of 5 to 8.

The polyoxy alkylene moiety present in the main chain of the polyol resin imparts the glossiness to the toner image. The presence of the polyoxy alkylene moiety in the main chain of the polyol resin can be confirmed by NMR.

As mentioned above, the polyol resin for use in the present invention can be synthesized by allowing the epoxy resin (a), the dihydric phenol (b), and the alkylene adduct component (c) to react.

As the epoxy resin (a) for use in the synthesis of the polyol resin, for instance, there can be employed epoxy resins that are obtained by subjecting bisphenol A or bisphenol and an epichlorohydrin resin to condensation reaction.

When the epoxy resin (a) is synthesized, using at least two bisphenol A type epoxy resins, each having a different number average molecular weight, the molecular weight distribution of the synthesized epoxy resin (a) can be adjusted appropriately, so that the use of the thus synthesized epoxy resin in the preparation of the polyol resin provides a color toner that is capable of providing color images with stable glossiness over a wide image fixing temperature range. In this case, it is preferable that one of the bisphenol A type epoxy resins have a number average molecular weight of 360 to 2,000, and that the other bisphenol A type epoxy resin have a number average molecular weight of 3,000 to 10,000.

As the dihydric phenol (b), bisphenols such as bisphenol A and bisphenol F are preferable for use in the preparation of the polyol resin.

Specific examples of the alkylene oxide adduct component (c) for use in the synthesis of the polyol resin are reaction products of (1) an alkylene oxide such as ethylene oxide, propylene oxide, butylene oxide or a mixture thereof, and (2) a bisphenol such as bisphenol A or bisphenol F; and glycidyl ethers of the thus obtained alkylene oxide adducts, which are obtained by glycidylating the thus obtained alkylene oxide adducts, using epichlorohidrin, or β-methylepichlorohydrin.

It is preferable that any of the above-mentioned alkylene oxide adduct components (c) be contained in the polyol resin in an amount of 10 to 50 parts by weight with respect to 100 parts by weight of the polyol resin, since the use of the polyol resin synthesized using the alkylene oxide adduct component in the toner imparts the toner the performance of providing color images with clear colors, sufficient glossiness, stable glossiness over a wide image fixing temperature range, and uniform glossiness.

When the amount of any of the above-mentioned alkylene oxide adduct components (c) in the polyol resin is less than 10 parts by weight with respect to 100 parts by weight of the polyol resin, the above-mentioned advantageous effects are not always obtained effectively, while when the amount of any of the above-mentioned alkylene oxide adduct components (c) in the polyol resin is more than 50 parts by weight with respect to 100 parts by weight of the polyol resin, the glossiness of the image tends to become excessive or the preservativity of the toner tends to be lowered.

When the amount of the glycidyl ether in the polyol resin is too small, a printed copy paper tends to curl increasingly, and the glossiness of the image also tends to become excessive or the preservativity of the toner tends to be lowered.

As the diglycidyl ether of the alkylene oxide adduct component (c), a diglycidyl ether of an alkylene oxide adduct of bisphenol A represented by the following general formula (1) is particularly preferable for use in the present invention:

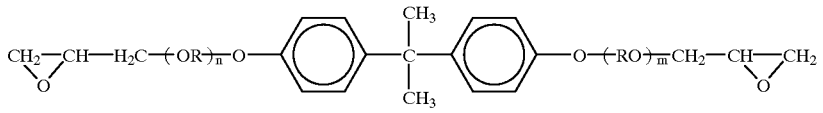

wherein R is —$CH_2$—$CH_2$—, —$CH_2$—$CH(CH_3)$—or —$CH_2$—$CH_2$—$CH_2$—; and n and m are each an integer of 1 or more, provided that n+m=2 to 8.

When n+m is more than 8, it may be possible that the glossiness of the image becomes excessive or that the preservativity of the toner is lowered.

It is also preferable that the parts-by-weight ratio of the epoxy resin (a): the dihydric phenol (b): the alkylene adduct component (c) be (25 to 70): (10 to 40): (15 to 40).

It is also preferable that the polyol resin be free of terminal epoxy group and have an epoxy value of 20,000 or more to obtain excellent production stability and to avoid the induction of skin hypersensitivity even when the toner accidentally comes into contact with the skin during manufacture, handling and use.

In order to obtain such polyol resin, a terminal epoxy group is allowed to react with monohydric phenol, or a dihydric phenol in an excessive amount.

Examples of the monohydric phenol that can be allowed to react with the terminal epoxy group are phenol, cresol, isopropylphenol, amylphenol, nonylphenol, dodecylphenol, xylenol, and p-cumylphenol.

Examples of the dihydric phenol that can be allowed to react with the terminal epoxy group are bisphenols such as bisphenol A and bisphenol B.

It is preferable that the polyol resin have a softening point of 115° C. to 130° C. in order to obtain color images with stable glossiness over a wide image fixing temperature range. When the softening point of the polyol resin is below 115° C., there is a tendency that a sufficiently wide image fixing temperature range cannot always be obtained, while when the softening point of the polyol resin is above 130° C., there is a tendency that sufficiently stable glossiness cannot always be obtained.

When the polyol resin, which is synthesized by using the alkylene adduct component (c) in an amount of 10 to 40 parts by weight with respect to 100 parts by weight of the polyol resin synthesized, is used in the toner of the present invention, clear and glossy color images, with stable and uniform glossiness over a wide image fixing temperature range can be obtained.

When a polyol resin, which is synthesized according to the above-mentioned method, using the alkylene adduct component (c) in an amount of less than 10 parts by weight with respect to 100 parts by weight of the polyol resin synthesized, is used in the toner, a printed copy paper tends to curl increasingly, while when a polyol resin, which is synthesized according to the above-mentioned method, using the alkylene adduct component (c) in an amount of more than 30 parts by weight with respect to 100 parts by weight of the polyol resin synthesized, is used in the toner, the glossiness of the image also tends to become excessive and the preservativity of the toner tends to be lowered.

It is preferable that the releasing agent have a melting point of 70° C. to 100° C. in order to obtain the toner with excellent preservability. When a releasing agent having a melting point below 70° C. is used in the toner, not only the preservability of the toner, but also the glossiness of the image is lowered, with the formation of a rough image surface in the copy. When a releasing agent having a melting point above 100° C. is used in the toner, the glossiness of the image is lowered, with the formation of a rough image surface in the copy, so that the images formed, using the toner, are poor in quality and not suitable for color images.

Specific examples of the releasing agents for use in the present invention are synthesized waxes such as low-molecular weight polyethylene, polypropylene and copolymers thereof; vegetable waxes such as candelilla wax, carnauba wax, rice wax, Japan wax, and jojaba wax; animal waxes such as bees wax, lanolin and spermaceti; mineral waxes such as montan wax, and ozocerite; and fat-and-oil type waxes such as hardened castor oil, hydroxystearic acid, fatty acid amide, and esters of phenols and fatty acids.

From the view point of chemical structures of the waxes, hydrocarbon waxes, ester waxes and amide waxes are known. However, ester waxes are preferable for use in the toner of the present invention in view of the evaluation of the preservability thereof, image quality obtained, and the image fixing temperature range thereof.

It is preferable that the amount of the releasing agent be in the range of 1 to 6 parts by weight of 100 parts by weight of the total weight of the toner. When the amount of the releasing agent is less than 1 part by weight, there is a tendency that sufficient glossiness cannot be obtained with the formation of a rough surface in the images obtained, so that the quality of the images obtained is poor and not suitable as color images, while when the amount of the releasing agent is more than 6 parts by weight, there is a tendency that a problem is caused in the preservation stability of the toner, and that the glossiness of images is lowered, with the formation of a rough surface in the images obtained.

As the coloring agent for use in the toner of the present invention, conventionally known dyes and pigments can be employed. Examples of the dyes and pigments are carbon black, nigrosine dyes, black iron oxide, Naphthol Yellow S, Hansa Yellow (10G, 5G, G), cadmium yellow, yellow iron oxide, yellow ochre, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthragen Yellow BGL, isoindolinone yellow, red oxide, red lead oxide, red lead, cadmium red, cadmium mercury red, antimony red, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chrome oxide, Persian, emerald green, Pigment Green B, Naphthol Green B, Green Gold, Acid Green Lake, Malachite Green Lake, Phthalocyanine Green, Anthraquinone Green, titanium oxide, zinc white, and lithopone, and mixtures thereof.

It is preferable that the amount of the coloring agent be in the range of 0.1 to 50 parts by weight to 100 parts by weight of the binder resin.

The dry toner according to the present invention may further comprise a charge controlling agent. Any conventional charge controlling agents can be used in the present invention. For instance, there can be employed a nigrosine dye, a triphenylmethane dye, a chromium-containing metal complex dye, a molybdic acid chelate pigment, a rhodamine dye, an alkoxyamine, a quaternary ammonium salt including a fluorine-modified quaternary ammonium salt, alkylamide, phosphorus, a phosphorus-containing compound, tungsten, a tungsten-containing compound, a fluorine-containing active material, a metallic salt of salicylic acid and a metallic salt of a salicylic acid derivative.

In addition, the toner of the present invention may further comprise additives, for example, colloidal silica, hydrophobic silica, fatty acid metallic salts such as zinc stearate and aluminum stearate, metallic oxides such as titanium oxide, aluminum oxide, tin oxide and antimony oxide, and fluoropolymers.

The dry toner of the present invention can be used for a mono-component developer, or a two-component developer in combination with a carrier. As the carrier, conventionally known materials such as iron powders, ferrite particles and glass beads can be employed. These carrier particles may be coated with a resin, such as polyfluorocarbon, polyvinyl chloride, polyvinylidene chloride, phenolic resin, polyvinyl acetal or silicone resin. In this case, it is proper that the amount of the toner be in the range of 0.5 to 6.0 parts by weight to 100 parts by weight of the carrier.

The softening point of the polyol resin for use in the present invention can be measured, using a commercially available full-automatic dropping point measurement apparatus (Trademark "FP5/FP53" made by Mettler Co., Ltd.), in accordance with the following procedure:

(1) A pulverized polyol resin sample is placed in a fusing jar and is allowed to stand for 20 minutes. The fused polyol resin sample is then poured into a sample cup with a dropping hole diameter of 6.35 mm up to a brim of the sample cup, cooled to room temperature, and then set in a cartridge.

(2) The measurement conditions for FP-5 control unit are set in such a manner that a temperature elevation rate is set at 1° C./min and a measurement initiation temperature displayed in a panel B is set at a temperature which is lower by 15° C. than an expected softening point of the sample.

(3) The cartridge is then set in a heating furnace of FP-53 and allowed to stand for 30 seconds. Thereafter, a start lever is pushed down, whereby the measurement is started. Thereafter the measurement is automatically carried out.

(4) After the measurement, the cartridge is detached.

(5) The softening point (° C.) is calculated by adding a value indicated in a result display panel A of FP-5 to a correction value (the value indicated in the result display panel A of FP-5+a correction value).

The value obtained by the addition of the value indicated in the result display panel of FP-5 to the correction value corresponds to a value obtained by Duran's mercury method.

When the difference between the value displayed in the result display panel A and the measurement initiation temperature displayed in the panel B is not more than 15° C., the above measurement is carried out once again.

The glass transition point (Tg) of the polyol resin is measured, using a commercially available apparatus ("DSC-200" (Trademark), made by Seiko Instruments Inc.) in accordance with the following procedure:

(1) 10±1 mg of a pulverized polyol resin sample is placed in an aluminum test sample container, and the container is closed with an aluminum lid.

(2) The glass transition point (Tg) of the resin sample is measured in an atmosphere of nitrogen by the DSC (differential scanning calorimeter) method.

The conditions for the analysis for the measurement of the Tg are as follows:

The resin sample is heated from room temperature to 150° C. with a temperature increasing rate of 20° C./min and is then allowed to stand at 150° C. for 10 minutes. The resin sample is then cooled to 0° C. at a temperature decreasing rate of 50° C./min and is then allowed to stand to stand for 10 minutes. In a stream of nitrogen (20 ml/min), the resin sample is again heated to 150° C. with a temperature increasing rate of 20° C./min and subjected to the DSC measurement. The Tg is measured by reading a peak rise-up temperature, using an analysis software with a trade mark of "Tg Job".

The epoxy equivalent of the polyol resin for use in the present invention is measured in accordance with an indicator titration method defined in paragraph 4.2 of Japanese Industrial Standards JIS K7236.

Other features of this invention will become apparent in the course of the following description of exemplary embodiments, which are given for illustration of the invention and are not intended to be limiting thereof.

EXAMPLE 1

[Preparation of Yellow Toner No. 1, Magenta Toner No. 1, Cyan Toner No. 1 and Black Toner No. 1]

A mixture of the following components with the following formulation was separately kneaded with the application of heat thereto, cooled, then roughly ground in a hammer mill, finely pulverized in an air-jet grinder, and then classified, whereby Yellow Toner No. 1, Magenta Toner No. 1, Cyan Toner No. 1 and Black Toner No. 1 with a particle size of 5 to 15 μm were prepared:

| | Parts by Weight |
|---|---|
| [Formulation of Yellow Toner No. 1] | |
| Polyol resin 1 (Mn: 4200, Mw/Mn: 6.2, the content of alkylene oxide addition product: 20 parts by weight, with the presence of the polyoxy alkylene moiety of the main chain thereof being confirmed by NMR, Tg: 61° C., Softening point: 120° C., Epoxy resin composed of two bisphenol A type epoxy resins, with the parts by weight ratio of the epoxy resin/the alkylene oxide addition product being 38, Epoxy equivalent: 20,000 or more) | 100 |
| Carnauba wax (Ester wax, Melting point: about 83° C.) | 3 |
| Yellow pigment, "Lionol Yellow FGN-T" (Trademark), made by Toyo Ink Mfg. Co., Ltd. | 5 |
| Zinc tert-butyl salicylate (Trademark "E-84" made by Orient Chemical Industries, Ltd.) serving as a charge controlling agent | 2 |
| [Formulation of Magenta Toner No. 1] | |
| Polyol resin No. 1 | 100 |
| Carnauba wax (Ester wax, Melting point: about 83° C.) | 3 |
| Red pigment "Lionogen Magenta R" (Trademark), made by Toyo Ink Mfg. Co., Ltd. | 5 |
| Zinc tert-butyl salicylate (Trademark "E-84" made by Orient Chemical Industries, Ltd.) serving as a charge controlling agent | 2 |
| [Formulation of Cyan Toner No. 1] | |
| Polyol resin No. 1 | 100 |
| Carnauba wax (Ester wax, Melting point: about 83° C.) | 3 |
| Blue pigment "Lionol Blue FG-7351" (Trademark), made by Toyo Ink Mfg. Co., Ltd. | 2 |
| Zinc tert-butyl salicylate (Trademark "E-84" made by Orient Chemical Industries, Ltd.) serving as a charge controlling agent | 2 |
| [Formulation of Black Toner No. 1] | |
| Polyol resin No. 1 | 100 |
| Carnauba wax (Ester wax, Melting point: about 83° C.) | 3 |
| Black pigment (carbon black) | 4.5 |
| Zinc tert-butyl salicylate (Trademark "E-84" made by Orient Chemical Industries, Ltd.) serving as a charge controlling agent | 2 |

5 parts by weight of each of the above prepared Yellow Toner No. 1, Magenta Toner No. 1, Cyan Toner No. 1 and Black Toner No. 1 were mixed with 95 parts by weight of spherical ferrite particles coated with a silicone resin, having an average particle size of 50 μm, whereby a two-component yellow developer No. 1, a two-component magenta developer No. 1, a two-component cyan developer No. 1 and a two-component black developer were respectively prepared.

Each of the thus prepared two-component yellow developer No. 1, two-component magenta developer No. 1, two-component cyan developer No. 1 and two-component black developer was set in a commercially available electrophotographic color copying machine (Trademark "PRETER 550" made by Ricoh Company, Ltd.) and a latent electrostatic image was developed for each color by successively using these color developers, and a developed color toner image was then transferred to a copy paper, whereby a color toner image bearing copy was obtained.

The color toner image transferred to the copy paper was then fixed thereto, using a simple roller fixing unit with an oil pad in an image fixing portion thereof. As a result, a clear full-color image with an average glossiness of 25% was formed.

The quality of the thus obtained full-color image was inspected as the image fixing temperature therefor was changed. The image fixing temperature range in which good full-color image can be obtained was 30° C. in terms of the width of the range.

The above full-color image was transferred and fixed to a transparent sheet for an overhead projector (OHP), and the full-color image was projected on a screen using the overhead projector. The result was that a completely clear full-color image was projected on the screen.

Each of the above prepared Yellow Toner No. 1, Magenta Toner No. 1, Cyan Toner No. 1 and Black Toner No. 1 in an amount of 10 g was separately placed in a 20-ml glass container, and each of the glass containers was allowed to stand in a temperature-constant chamber with the temperature therein set at 50° C. for 5 hours, and then the degree of the penetration of a loaded needle into each of the toners was measured. The result was that the degree of the penetration of a loaded needle into each of the toners was 20 or more.

The glossiness of the thus obtained full-color image was measured as follows:

Each of the above-mentioned two-component yellow developer No. 1, two-component magenta developer No. 1, two-component cyan developer No. 1 and two-component black developer No. 1 was set in the above-mentioned commercially available electrophotographic color copying machine (Trademark "PRETER 550" made by Ricoh Company, Ltd.), and yellow, magenta, cyan and black solid images are separately formed and transferred to a transfer sheet (Trademark "6000-70W" made by Ricoh Company, Ltd.) with a toner deposition amount for the development of 0.8 mg/cm$^2$ and were fixed thereto at an image fixing temperature of 160° C.

Each of the thus obtained four single color solid image samples was subjected to glossiness measurement, using a commercially available gloss meter (Trademark "VG-1D" made by Nippon Denshoku Kogyo Co., Ltd.) with each of an angle of incidence and an angle of reflection being set at 60°, a S, S/10 switch set at S, using a zero preparation plate and a standard preparation plate.

EXAMPLE 2

[Preparation of Yellow Toner No. 2, Magenta Toner No. 2, Cyan Toner No. 2 and Black Toner No. 2]

A mixture of the following components with the following formulation was separately kneaded with the application of heat thereto, cooled, then roughly ground in a hammer mill, finely pulverized in an air-jet grinder, and then classified, whereby Yellow Toner No. 2, Magenta Toner No. 2, Cyan Toner No. 2 and Black Toner No. 2 with a particle size of 5 to 15 μm were prepared:

| | Parts by Weight |
|---|---|
| [Formulation of Yellow Toner No. 2] | |
| Polyol resin 2 (Mn: 5200, Mw/Mn: 7.2, the content of alkylene oxide addition product: 25 parts by weight, with the presence of the polyoxy alkylene moiety of the main chain thereof being confirmed by NMR, Tg: 63° C., Softening point: 130° C., Epoxy resin composed of two bisphenol A type epoxy resins, with the parts by weight ratio of the epoxy resin/the alkylene oxide addition product being 48, Epoxy equivalent: 20,000 or more) | 100 |
| Jojoba wax (Ester wax, Melting point: about 74° C.) | 3 |
| Yellow pigment (Trademark "Lionol Yellow FGN-T", made by Toyo Ink Mfg. Co., Ltd.) | 5 |
| Zinc tert-butyl salicylate (Trademark "E-84" made by Orient Chemical Industries, Ltd.) serving as a charge controlling agent | 2 |
| [Formulation of Magenta Toner No. 2] | |
| Polyol resin No. 2 | 100 |
| Jojoba wax (Ester wax, Melting point: about 74° C.) | 3 |
| Red pigment "Lionogen Magenta R" (Trademark), made by Toyo Ink Mfg. Co., Ltd. | 5 |
| Zinc tert-butyl salicylate (Trademark "E-84" made by Orient Chemical Industries, Ltd.) serving as a charge controlling agent | 2 |
| [Formulation of Cyan Toner No. 2] | |
| Polyol resin No. 2 | 100 |
| Jojoba wax (Ester wax, Melting point: about 74° C.) | 3 |
| Blue pigment (Trademark "Lionol Blue FG-7351", made by Toyo Ink Mfg. Co., Ltd.) | 2 |
| Zinc tert-butyl salicylate (Trademark "E-84" made by Orient Chemical Industries, Ltd.) serving as a charge controlling agent | 2 |
| Formulation of Black Toner No. 2] | |
| Polyol resin No. 2 | 100 |
| Jojoba wax (Ester wax, Melting point: about 74° C.) | 3 |
| Black pigment (carbon black) | 4.5 |
| Zinc tert-butyl salicylate (Trademark "E-84" made by Orient Chemical Industries, Ltd.) serving as a charge controlling agent | 2 |

5 parts by weight of each of the above prepared Yellow Toner No. 2, Magenta Toner No. 2, Cyan Toner No. 2 and Black Toner No. 2 were mixed with 95 parts by weight of spherical ferrite particles coated with a silicone resin, having an average particle size of 50 μm, whereby a two-component yellow developer No. 2, a two-component magenta developer No. 2, a two-component cyan developer No. 2 and a two-component black developer No. 2 were respectively prepared.

Each of the thus prepared two-component yellow developer No. 2, two-component magenta developer No. 2, two-component cyan developer No. 2 and two-component black developer No. 2 was set in a commercially available electrophotographic color copying machine (Trademark "PRETER 550" made by Ricoh Company, Ltd.) and a latent electrostatic image was developed for each color by successively using these color developers, and a developed color toner image was then transferred to a copy paper, whereby a color toner image bearing copy was obtained.

The color toner image transferred to the copy paper was then fixed thereto, using a simple roller fixing unit with an oil pad in an image fixing portion thereof. As a result, a clear full-color image with an average glossiness of 16% was formed.

The quality of the thus obtained full-color image was inspected as the image fixing temperature therefor was changed. The image fixing temperature range in which good full-color image can be obtained was 35° C. in terms of the width of the range.

The above full-color image was transferred and fixed to a transparent sheet for an overhead projector (OHP), and the full-color image was projected on a screen using the overhead projector. The result was that a completely clear full-color image was projected on the screen.

Each of the above prepared Yellow Toner No. 2, Magenta Toner No. 2, Cyan Toner No. 2 and Black Toner No. 2 in an amount of 10 g was separately placed in a 20-ml glass container, and each of the glass containers was allowed to stand in a temperature-constant chamber with the temperature therein set at 50° C. for 5 hours, and then the degree of the penetration of a loaded needle into each of these toners was measured. The result was that the degree of the penetration of a loaded needle into each of the toners was 20 or more.

EXAMPLE 3

[Preparation of Yellow Toner No. 3, Magenta Toner No. 3, Cyan Toner No. 3 and Black Toner No. 3]

A mixture of the following components with the following formulation was separately kneaded with the application of heat thereto, cooled, then roughly ground in a hammer mill, finely pulverized in an air-jet grinder, and then classified, whereby Yellow Toner No. 3, Magenta Toner No. 3, Cyan Toner No. 3 and Black Toner No. 3 with a particle size of 5 to 15 μm were prepared:

| | Parts by Weight |
|---|---|
| [Formulation of Yellow Toner No. 3] | |
| Polyol resin 1 | 100 |
| Polypropylene wax (Trademark "NP055", made by Mitsui Petrochemical Industries, Ltd., Melting point: 155° C.) | 3 |
| Yellow pigment (Trademark "Lionol Yellow FGN-T", made by Toyo Ink Mfg. Co., Ltd.) | 5 |
| Zinc tert-butyl salicylate (Trademark "E-84" made by Orient Chemical Industries, Ltd.) serving as a charge controlling agent | 2 |
| [Formulation of Magenta Toner No. 3] | |
| Polyol resin No. 1 | 100 |
| Polypropylene wax (Trademark "NP055", made by Mitsui Petrochemical Industries, Ltd., Melting point: 155° C.) | 3 |
| Red pigment "Lionogen Magenta R" (Trademark), made by Toyo Ink Mfg. Co., Ltd. | 5 |
| Zinc tert-butyl salicylate (Trademark "E-84" made by Orient Chemical Industries, Ltd.) serving as a charge controlling agent | 2 |
| [Formulation of Cyan Toner No. 3] | |
| Polyol resin No. 1 | 100 |
| Polypropylene wax (Trademark "NP055", made by Mitsui Petrochemical Industries, Ltd., Melting point: 155° C.) | 3 |
| Blue pigment (Trademark "Lionol Blue FG-7351", made by Toyo Ink Mfg. Co., Ltd.) | 2 |
| Zinc tert-butyl salicylate (Trademark "E-84" made by Orient Chemical Industries, Ltd.) serving as a charge controlling agent | 2 |
| [Formulation of Black Toner No. 3] | |
| Polyol resin No. 1 | 100 |
| Polypropylene wax (Trademark "NP055", made by Mitsui Petrochemical Industries, Ltd., Melting point: 155° C.) | 3 |
| Black pigment (carbon black) | 4.5 |
| Zinc tert-butyl salicylate (Trademark "E-84" made by Orient Chemical Industries, Ltd.) serving as a charge controlling agent | 2 |

5 parts by weight of each of the above prepared Yellow Toner No. 3, Magenta Toner No. 3, Cyan Toner No. 3 and Black Toner No. 3 were mixed with 95 parts by weight of spherical ferrite particles coated with a silicone resin, having an average particle size of 50 μm. whereby a two-component yellow developer No. 3, a two-component magenta developer No. 3, a two-component cyan developer No, 3 and a two-component black developer No. 3 were respectively prepared.

Each of the thus prepared two-component yellow developer No. 3, two-component magenta developer No. 3, two-component cyan developer No. 3 and two-component black developer No. 3 was set in a commercially available electrophotographic color copying machine (Trademark "PRETER 550" made by Ricoh Company, Ltd.) and a latent electrostatic image was developed for each color by successively using these color developers, and a developed color toner image was then transferred to a copy paper, whereby a color toner image bearing copy was obtained.

The color toner image transferred to the copy paper was then fixed thereto, using a simple roller fixing unit with an oil pad in an image fixing portion thereof. As a result, a clear full-color image with an average glossiness of 10% was formed.

The quality of the thus obtained full-color image was inspected as the image fixing temperature therefor was changed. The image fixing temperature range in which good full-color image can be obtained was 15° C. in terms of the width of the range.

The above full-color image was transferred and fixed to a transparent sheet for an overhead projector (OHP), and the full-color image was projected on a screen using the overhead projector. The result was that a completely clear full-color image was projected on the screen.

Each of the above prepared Yellow Toner No. 3, Magenta Toner No. 3, Cyan Toner No. 3 and Black Toner No. 3 in an amount of 10 g was separately placed in a 20-ml glass container, and each of the glass containers was allowed to stand in a temperature-constant chamber with the temperature therein set at 50° C. for 5 hours, and then the degree of the penetration of a loaded needle into each of these toners was measured. The result was that the degree of the penetration of a loaded needle into each of the toners was 20 or more.

EXAMPLE 4

The same procedure for preparing Yellow Toner No. 1, Magenta Toner No. 1, Cyan Toner No. 1 and Black Toner No. 1 as in Example 1 was repeated except that the amount of carnauba wax in the formulation of each of the above toners was reduced to 0.5 parts by weight, whereby Yellow Toner No. 4, Magenta Toner No. 4, Cyan Toner No. 4 and Black Toner No. 4 were prepared.

Image formation was then conducted in the same manner as in Example 1. As a result, a clear full-color image with an average glossiness of 12% was formed.

The quality of the thus obtained full-color image was then inspected as the image fixing temperature therefor was changed. The image fixing temperature range in which good full-color image can be obtained was 15° C. in terms of the width of the range.

Furthermore, the above full-color image was transferred and fixed to a transparent sheet for an overhead projector (OHP), and the full-color image was projected on a screen using the overhead projector. The result was that a completely clear full-color image was projected on the screen.

Each of the above prepared Yellow Toner No. 4, Magenta Toner No. 4, Cyan Toner No. 4 and Black Toner No. 4 in an amount of 10 g was separately placed in a 20-mi glass container, and each of the glass containers was allowed to stand in a temperature-constant chamber with the temperature therein set at 50° C. for 5 hours, and then the degree of the penetration of a loaded needle into each of these toners was measured. The result was that the degree of the penetration of a loaded needle into each of the toners was 20 or more.

EXAMPLE 5

The same procedure for preparing Yellow Toner No. 1, Magenta Toner No. 1, Cyan Toner No. 1 and Black Toner No. 1 as in Example 1 was repeated except that the amount of carnauba wax in the formulation of each of the above toners was increased to 10 parts by weight, whereby Yellow Toner No. 5, Magenta Toner No. 5, Cyan Toner No. 5 and Black Toner No. 5 were prepared.

Image formation was conducted in the same manner as in Example 1. As a result, a clear full-color image with an average glossiness of 25% was formed.

The quality of the thus obtained full-color image was then inspected as the image fixing temperature therefor was changed. The image fixing temperature range in which good full-color image can be obtained was 15° C. in terms of the width of the range.

Furthermore, the above full-color image was transferred and fixed to a transparent sheet for an overhead projector (OHP), and the full-color image was projected on a screen using the overhead projector. The result was that a completely clear full-color image was projected on the screen.

Each of the above prepared Yellow Toner No. 5, Magenta Toner No. 5, Cyan Toner No. 5 and Black Toner No. 5 in an amount of 10 g was separately placed in a 20-ml glass container, and each of the glass containers was allowed to stand in a temperature-constant chamber with the temperature therein set at 50° C. for 5 hours, and then the degree of the penetration of a loaded needle into each of these toners was measured. The result was that the degree of the penetration of a loaded needle into each of the toners was 12 or more.

EXAMPLE 6

The same procedure for preparing Yellow Toner No. 1, Magenta Toner No. 1, Cyan Toner No. 1 and Black Toner No. 1 as in Example 1 was repeated except that the carnauba wax employed in the formulation of each of the above toners was replaced by candelilla wax (ester wax, m.p. about 69° C.), whereby Yellow Toner No. 6, Magenta Toner No. 6, Cyan Toner No. 6 and Black Toner No. 6 were prepared.

Image formation was then conducted in the same manner as in Example 1. As a result, a clear full-color image with an average glossiness of 8% was formed.

The quality of the thus obtained full-color image was then inspected as the image fixing temperature therefor was changed. The image fixing temperature range in which good full-color image can be obtained was 10° C. in terms of the width of the range.

Furthermore, the above full-color image was transferred and fixed to a transparent sheet for an overhead projector (OHP), and the full-color image was projected on a screen using the overhead projector. The result was that a completely clear full-color image was projected on the screen.

Each of the above prepared Yellow Toner No. 6, Magenta Toner No. 6, Cyan Toner No. 6 and Black Toner No. 6 in an amount of 10 g was separately placed in a 20-ml glass container, and each of the glass containers was allowed to stand in a temperature-constant chamber with the temperature therein set at 50° C. for 5 hours, and then the degree of the penetration of a loaded needle into each of these toners was measured. The result was that the degree of the penetration of a loaded needle into each of the toners was zero (0).

EXAMPLE 7

The same procedure for preparing Yellow Toner No. 1, Magenta Toner No. 1, Cyan Toner No. 1 and Black Toner No. 1 as in Example 1 was repeated except that the carnauba wax employed in the formulation of each of the above toners was replaced by microcrystalline wax (m.p. 91° C., Trademark "C700", made by Petrolite Co., Ltd.), whereby Yellow Toner No. 7, Magenta Toner No. 7, Cyan Toner No. 7 and Black Toner No. 7 were prepared.

Image formation was conducted in the same manner as in Example 1. As a result, a clear full-color image with an average glossiness of 12% was formed.

The quality of the thus obtained full-color image was then inspected as the image fixing temperature therefor was changed. The image fixing temperature range in which good full-color image can be obtained was 10° C. in terms of the width of the range.

Furthermore, the above full-color image was transferred and fixed to a transparent sheet for an overhead projector (OHP), and the full-color image was projected on a screen using the overhead projector. The result was that a completely clear full-color image was projected on the screen.

Each of the above prepared Yellow Toner no. 7, Magenta Toner No. 7, Cyan Toner No. 7 and Black Toner No. 7 in an amount of 10 g was separately placed in a 20-ml glass container, and each of the glass containers was allowed to stand in a temperature-constant chamber with the temperature therein set at 50° C. for 5 hours, and then the degree of the penetration of a loaded needle into each of these toners was Measured. The result was that the degree of the penetration of a loaded needle into each of the toners was 5 or more.

EXAMPLE 8

The same procedure for preparing Yellow Toner No. 1, Magenta Toner No. 1, Cyan Toner No. 1 and Black Toner No. 1 as in Example 1 was repeated except that Polyol resin No. 1 employed in the formulation of each of the above toners was replaced by Polyol resin No. 3 (Mn: 3300, Mw/Mn: 6.5, the content of alkyleme oxide addition product: 25 parts by weight, with the presence of the polyoxy alkylene moiety of the main chain thereof being confirmed by NMR, Tg: 61° C., Softening point: 118° C., Epoxy resin composed of two bisphenol A type epoxy resins, with the parts by weight ratio of the epoxy resin/the alkylene oxide addition product being 48, Epoxy equivalent: 1750), whereby Magenta Toner No. 8, Cyan Toner No. 8 and Black Toner No. 8 were prepared.

With respect to Yellow Toner No. 8, in the course of the preparation of Yellow Toner No.8, the mixture of the components thereof was gelled, so that it was impossible to prepare Yellow Toner No. 8.

Using the other three toners, image formation was conducted in the same manner as in Example 1. As a result, a clear full-color image with an average glossiness of 25% was formed.

The quality of the thus obtained full-color image was then inspected as the image fixing temperature therefor was changed. The image fixing temperature range in which good full-color image can be obtained was 30° C. in terms of the width of the range.

Furthermore, the above full-color image was transferred and fixed to a transparent sheet for an overhead projector (OHP), and the full-color image was projected on a screen using the overhead projector. The result was that a completely clear full-color image was projected on the screen.

Each of the above prepared Magenta Toner No. 8, Cyan Toner No. 8 and Black Toner No. 8 in an amount of 10 g was separately placed in a 20-ml glass container, and each of the glass containers was allowed to stand in a temperature-constant chamber with the temperature therein set at 50° C. for 5 hours, and then the degree of the penetration of a loaded needle into each of these toners was measured. The result was that the degree of the penetration of a loaded needle into each of the toners was 20 or more.

EXAMPLE 9

The same procedure for preparing Yellow Toner No. 1, Magenta Toner No. 1, Cyan Toner No. 1 and Black Toner No. 1 as in Example 1 was repeated except that Polyol resin No. 1 employed in the formulation of each of the above toners was replaced by Polyol resin No. 4 (Mn: 3600, Mw/Mn: 4.3, the content of alkylene oxide addition product: 25 parts by weight, with the presence of the polyoxy alkylene moiety of the main chain thereof being confirmed by NMR, Tg: 59° C., Softening point: 112° C., Epoxy resin composed of two bisphenol A type epoxy resins, with the parts by weight ratio of the epoxy resin/the alkylene oxide addition product being 48, Epoxy equivalent: 20,000 or more), whereby Yellow Toner No. 9, Magenta Toner No. 9, Cyan Toner No. 9 and Black Toner No. 9 were prepared.

Using these four toners, image formation was conducted in the same manner as in Example 1. As a result, a clear full-color image with an average glossiness of 8% was formed.

The quality of the thus obtained full-color image was then inspected as the image fixing temperature therefor was changed. The image fixing temperature range in which good full-color image can be obtained was 5° C. in terms of the width of the range.

Furthermore, the above full-color image was transferred and fixed to a transparent sheet for an overhead projector (OHP), and the full-color image was projected on a screen using the overhead projector. The result was that a completely clear full-color image was projected on the screen.

Each of the above prepared Yellow Toner No. 9, Magenta Toner No. 9, Cyan Toner No. 9 and Black Toner No. 9 in an amount of 10 g was separately placed in a 20-ml glass container, and each of the glass containers was allowed to stand in a temperature-constant chamber with the temperature therein set at 50° C. for 5 hours, and then the degree of the penetration of a loaded needle into each of these toners was measured. The result was that the degree of the penetration of a loaded needle into each of the toners was 20 or more.

EXAMPLE 10

The same procedure for preparing Yellow Toner No. 1, Magenta Toner No. 1, Cyan Toner No. 1 and Black Toner No. 1 as in Example 1 was repeated except that Polyol resin No. 1 employed in the formulation of each of the above toners was replaced by Polyol resin No. 5 (Mn: 5500, Mw/Mn: 7.8, the content of alkylene oxide addition product: 30 parts by weight, with the presence of the polyoxy alkylene moiety of the main chain thereof being confirmed by NMR, Tg: 63° C., Softening point: 133° C., Epoxy resin composed of two bisphenol A type epoxy resins, with the parts by weight ratio of the epoxy resin/the alkylene oxide addition product being 58, Epoxy equivalent: 20,000 or more), whereby Yellow Toner No. 10, Magenta Toner No. 10, Cyan Toner No. 10 and Black Toner No. 10 were prepared.

Using these four toners, image formation was conducted in the same manner as in Example 1. As a result, a clear full-color image with an average glossiness of 5% was formed.

The quality of the thus obtained full-color image was then inspected as the image fixing temperature therefor was changed. The image fixing temperature range in which good full-color image can be obtained was 30° C. in terms of the width of the range.

Furthermore, the above full-color image was transferred and fixed to a transparent sheet for an overhead projector (OHP), and the full-color image was projected on a screen using the overhead projector. The result was that a completely clear full-color image was projected on the screen.

Each of the above prepared Yellow Toner No. 10, Magenta Toner No. 10, Cyan Toner No. 10 and Black Toner No. 10 in an amount of 10 g was separately placed in a 20-ml glass container, and each of the glass containers was allowed to stand in a temperature-constant chamber with the temperature therein set at 50° C. for 5 hours, and then the degree of the penetration of a loaded needle into each of these toners was measured. The result was that the degree of the penetration of a loaded needle into each of the toners was 20 or more.

EXAMPLE 11

The same procedure for preparing Yellow Toner No. 1, Magenta Toner No. 1, Cyan Toner No. 1 and slack Toner No. 1 as in Example 1 was repeated except that Polyol resin No. 1 employed in the formulation of each of the above toners was replaced by Polyol resin No. 6 (Mn 4700, Mw/Mn: 5.0, the content of alkylene oxide addition product: 2 parts by weight, with the presence of the polyoxy alkylene moiety of the main chain thereof being confirmed by NMR, Tg; 62° C., Softening point: 118° C., Epoxy resin composed of two bisphenol A type epoxy resins, with the parts by weight ratio of the epoxy resin/the alkylene oxide addition product being 4, Epoxy equivalent: 20,000 or more), whereby Yellow Toner No. 11, Magenta Toner No. 11, Cyan Toner No. 11 and Black Toner No. 11 were prepared.

Using these four toners, image formation was conducted in the same manner as in Example 1. As a result, a clear full-color image with an average glossiness of 8% was formed.

The quality of the thus obtained full-color image was then inspected as the image fixing temperature therefor was changed. The image fixing temperature range in which good full-color image can be obtained was 20° C. in terms of the width of the range.

Furthermore, the above full-color image was transferred and fixed to a transparent sheet for an overhead projector (OHP), and the full-color image was projected on a screen using the overhead projector. The result was that a completely clear full-color image was projected on the screen.

Each of the above prepared Yellow Toner No. 11, Magenta Toner No. 11, Cyan Toner No. 11 and Black Toner No. 11 in an amount of 10 g was separately placed in a 20-ml glass container, and each of the glass containers was allowed to stand in a temperature-constant chamber with the temperature therein set at 50° C. for 5 hours, and then the degree of the penetration of a loaded needle into each of these toners was measured. The result was that the degree of the penetration of a loaded needle into each of the toners was 20 or more.

COMPARATIVE EXAMPLE 1

The same procedure for preparing Yellow Toner No. 1, Magenta Toner No. 1, Cyan Toner No. 1 and Black Toner No. 1 as in Example 1 was repeated except that Polyol resin No. 1 employed in the formulation of each of the above toners was replaced by Polyol resin No. 7 (Mn: 3600, Mw/Mn: 3.5, the content of alkylene oxide addition product: 20 parts by weight, with the presence of the polyoxy alkylene moiety of the main chain thereof being confirmed by NMR, Tg: 58° C., Softening point: 110° C., Epoxy resin composed of two bisphenol A type epoxy resins, with the parts by weight ratio of the epoxy resin/the alkylene oxide addition product being 38, Epoxy equivalent: 20,000 or more), whereby Comparative Yellow Toner No. 1, Comparative Magenta Toner No. 1, Comparative Cyan Toner No. 1 and Comparative Black Toner No. 1 were prepared.

Using these four comparative toners, image formation was conducted in the same manner as in Example 1. As a result, a color image with an average glossiness of 0.5% was formed.

The quality of the thus obtained color image was then inspected as the image fixing temperature therefor was changed. The image fixing temperature range in which the color image can be obtained was substantially zero in terms of the width of the range.

Furthermore, the above color image was transferred and fixed to a transparent sheet for an overhead projector (OHP), and the color image was projected on a screen using the overhead projector. The result was that the image projected on the screen was dark and not clear.

Japanese Patent Application No. 09-072691 filed Mar. 10, 1997 is hereby incorporated by reference.

What is claimed is:

1. A dry toner for electrophotography comprising:

a coloring agent, a releasing agent, and a polyol resin having a polyoxy alkylene moiety in a main chain thereof, with a ratio of Mw/Mn of 4 to 10, in which Mw and Mn are respectively the weight average molecular weight and the number average molecular weight of said polyol resin, said polyol resin, serving as a binder resin, synthesized by allowing (a) an epoxy resin, (b) a dihydric phenol, and (c) an alkylene oxide adduct of a dihydric phenol, or a glycidyl ether thereof, which is referred to as an alkylene adduct component, to react.

2. The dry toner for electrophotography as claimed in claim 1, wherein said polyol resin is synthesized by using said alkylene adduct component in an amount of 10 to 40 parts by weight with respect to 100 parts by weight of said polyol resin synthesized.

3. The dry toner for electrophotography as claimed in claim 1, wherein said epoxy resin comprises at least two bisphenol A type epoxy resins, each having a different number average molecular weight.

4. The dry toner for electrophotography as claimed in claim 1, wherein said polyol resin has an epoxy equivalent of 20,000 or more.

5. The dry toner for electrophotography as claimed in claim 1, wherein said polyol resin has a softening point of 115° C. to 130° C.

6. The dry toner for electrophotography as claimed in claim 1, wherein said alkylene adduct component is in an amount of 10 to 50 parts by weight with respect to 100 parts by weight of said epoxy resin in said polyol resin.

7. The dry toner for electrophotography as claimed in claim 1, wherein said releasing agent has a melting point of 70° C. to 100° C.

8. The dry toner for electrophotography as claimed in claim 2, wherein said polyol resin has an epoxy equivalent of 20,000 or more.

9. The dry toner for electrophotography as claimed in claim 8, wherein said releasing agent has a melting point of 70° C. to 100° C.

10. The dry toner for electrophotography as claimed in claim 1, wherein said polyol resin has a ratio of Mw/Mn of 5 to 8.

11. The dry toner for electrophotography as claimed in claim 1, further comprising a charge controlling agent.

12. An electrophotographic process comprising developing a latent electrostatic image with the dry toner of claim 1.

13. A method for forming a dry toner, the method comprising mixing a coloring agent, a releasing agent and a polyol resin; and forming the dry toner of claim 1.

* * * * *

UNITED STATES PATENT AND TRADEMARK OFFICE

CERTIFICATE OF CORRECTION

PATENT NO. : 5,998,073

DATED : December 7, 1999

INVENTOR(S): Shinichi KURAMOTO, ET AL.

It is certified that an error appears in the above-identified patent and that said Letters Patent is hereby corrected as shown below:

Column 15, line 4 "alkyleme" should read --alkylene--.

Column 16, line 60 "slack" should read --Black--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*